US011809137B2

(12) United States Patent
Haemmerli et al.

(10) Patent No.: US 11,809,137 B2
(45) Date of Patent: Nov. 7, 2023

(54) BALANCE FOR TIMEPIECES AND METHOD FOR MANUFACTURING THE SAME

(71) Applicant: The Swatch Group Research and Development Ltd, Marin (CH)

(72) Inventors: Alexandre Haemmerli, Neuchatel (CH); Francois Gueissaz, Cormondreche (CH); Jean-Claude Martin, Montmollin (CH); Lionel Paratte, Marin-Epagnier (CH); Yves Winkler, Schmitten (CH); Gianni Di Domenico, Neuchatel (CH); Pascal Winkler, St-Blaise (CH); Jean-Luc Helfer, Le Landeron (CH); Lionel Tombez, Bevaix (CH); Baptiste Hinaux, Lausanne (CH); Donald William Corson, Yverdon-les-Bains (CH); Michel Willemin, Preles (CH)

(73) Assignee: The Swatch Group Research and Development Ltd, Marin (CH)

( * ) Notice: Subject to any disclaimer, the term of this patent is extended or adjusted under 35 U.S.C. 154(b) by 571 days.

(21) Appl. No.: 16/767,778

(22) PCT Filed: Dec. 3, 2018

(86) PCT No.: PCT/EP2018/083295
§ 371 (c)(1),
(2) Date: May 28, 2020

(87) PCT Pub. No.: WO2019/120959
PCT Pub. Date: Jun. 27, 2019

(65) Prior Publication Data

US 2021/0181679 A1 Jun. 17, 2021

(30) Foreign Application Priority Data

Dec. 22, 2017 (EP) ..... 17210298

(51) Int. Cl.
*G04B 17/22* (2006.01)

(52) U.S. Cl.
CPC ..... *G04B 17/227* (2013.01); *G04B 17/222* (2013.01)

(58) Field of Classification Search
CPC .. G04B 17/222; G04B 17/227; G04B 18/006; G04B 18/00
See application file for complete search history.

(56) References Cited

U.S. PATENT DOCUMENTS 208,238 A * 9/1878 Heinrich ..... G04B 17/222 368/171
455,787 A * 7/1891 Bilgram ..... G04B 17/222 368/171

(Continued)

FOREIGN PATENT DOCUMENTS

CH 564 218 A 7/1975
CN 1206861 A 2/1999

(Continued)

OTHER PUBLICATIONS

Balance—Berner's Horology Dictionary—Sep. 3, 2022.*

(Continued)

*Primary Examiner* — Sean Kayes
(74) *Attorney, Agent, or Firm* — Oblon, McClelland, Maier & Neustadt, L.L.P.

(57) ABSTRACT

A balance for timepieces includes a rim, a hub, and at least one arm connecting the hub to the rim. At least one portion of the balance is made of an at least partially amorphous metal alloy. The at least partially amorphous metal alloy is based on an element chosen from the group consisting of platinum, zirconium and titanium, and has a coefficient of thermal expansion comprised between 7 ppm/° C. and 12 ppm/° C. The balance can be manufactured by moulding. A (Continued)

resonator can include such a balance and a monocrystalline quartz balance spring.

15 Claims, 3 Drawing Sheets

(56) References Cited

U.S. PATENT DOCUMENTS

| | | | | |
|---|---|---|---|---|
| 492,184 | A * | 2/1893 | Bliss | G04B 17/222 368/171 |
| 798,993 | A * | 9/1905 | Culman | G04B 17/222 368/171 |
| 5,881,026 | A | 3/1999 | Baur et al. | |
| D650,301 | S * | 12/2011 | Greubel | D10/128 |
| 9,030,920 | B2 * | 5/2015 | Hessler | G04B 17/063 368/158 |
| 9,862,129 | B2 * | 1/2018 | Strahm | G04B 5/165 |
| 9,891,587 | B2 * | 2/2018 | Dubois | B81C 3/005 |
| 9,989,922 | B2 * | 6/2018 | Zaugg | G04B 17/063 |
| 2003/0179655 | A1 | 9/2003 | Scheufele | |
| 2007/0140065 | A1 | 6/2007 | Levingston | |
| 2010/0054090 | A1 | 3/2010 | Orny et al. | |
| 2011/0103197 | A1 | 5/2011 | Bühler et al. | |
| 2012/0024432 | A1 * | 2/2012 | Bazin | B21J 1/006 148/516 |
| 2014/0064044 | A1 * | 3/2014 | Hessler | G04B 17/066 368/158 |
| 2015/0003216 | A1 * | 1/2015 | Jamin | G04B 45/0046 156/263 |
| 2015/0266089 | A1 | 9/2015 | Bazin et al. | |
| 2017/0176935 | A1 | 6/2017 | Dubois et al. | |
| 2017/0351219 | A1 * | 12/2017 | Paratte | G04B 18/00 |

FOREIGN PATENT DOCUMENTS

| | | | |
|---|---|---|---|
| CN | 1652046 | A | 8/2005 |
| CN | 101390022 | A | 3/2009 |
| CN | 101391296 | A | 3/2009 |
| CN | 101589347 | A | 11/2009 |
| CN | 101978327 | A | 2/2011 |
| CN | 102224465 | A | 10/2011 |
| CN | 102339009 | A | 2/2012 |
| CN | 103676600 | A | 3/2014 |
| CN | 104282714 | A | 1/2015 |
| CN | 105388743 | A | 3/2016 |
| CN | 206178347 | U | 5/2017 |
| CN | 106896695 | A | 6/2017 |
| CN | 107168031 | A | 9/2017 |
| CN | 107463082 | A | 12/2017 |
| EP | 0 886 195 | A1 | 12/1998 |
| EP | 2 180 385 | A1 | 4/2010 |
| EP | 2 395 402 | A1 | 12/2011 |
| EP | 2 703 909 | A1 | 3/2014 |
| EP | 3 182 211 | A1 | 6/2017 |
| GB | 839448 | A | 6/1960 |
| GB | 0520481 | | 11/2005 |
| GB | 2 416 408 | A | 1/2006 |
| JP | 2007-533973 | A | 11/2007 |
| JP | 2010-513886 | A | 4/2010 |
| JP | 2011-526676 | A | 10/2011 |
| JP | 2012-512384 | A | 5/2012 |
| JP | 2014-52374 | A | 3/2014 |
| JP | 2017-111126 | A | 6/2017 |
| JP | 2017-219538 | A | 12/2017 |
| RU | 2010 142 923 | A | 4/2012 |

OTHER PUBLICATIONS

International Search Report dated Apr. 4, 2019 in PCT/EP2018/083295 filed on Dec. 3, 2018, 3 pages.

Combined Chinese Office Action and Search Report dated Apr. 6, 2022, in corresponding Chinese Patent Application No. 201880081961.6 (with English Translation and English Translation of Category of Cited Documents), 24 pages.

Combined Chinese Office Action and Search Report dated Mar. 3, 2021 in Chinese Patent Application No. 201880081961.6 (with English translation), 22 pages.

Japanese Office Action dated Jul. 13, 2021 in Japanese Patent Application No. 2020-530619 (with English translation), 11 pages.

* cited by examiner

BALANCE FOR TIMEPIECES AND METHOD FOR MANUFACTURING THE SAME

CROSS-REFERENCE TO RELATED APPLICATIONS

The present application is a national stage entry of International Application No. PCT/EP2018/083295, filed Dec. 3, 2018, which claims priority to European Patent Application No. 17210298.0, filed on Dec. 22, 2017, the entire content and disclosure of which are incorporated by reference herein.

FIELD OF THE INVENTION

The invention concerns a balance for timepieces comprising a rim, a hub and at least one arm connecting the hub to said rim, at least one portion of the balance being made of a partially or completely amorphous metal alloy. The present invention also concerns a method for manufacturing such a balance as well as a resonator comprising such a balance.

BACKGROUND OF THE INVENTION

One such balance made of amorphous metal alloy is disclosed, for example, in the published European Patent Application No. EP2466396. In this Patent Application, the balance is associated with a steel balance spring and an iron-based amorphous metal alloy is used for the balance, for its ferromagnetic properties. The problem that the invention, which is the subject of Patent Application EP2466396, seeks to solve therefore concerns the protection of the balance spring against external interfering magnetic fields which are likely to affect the frequency stability of the resonator.

The present invention concerns another parameter likely to affect the frequency stability of the resonator, which is not addressed in Patent Application EP2466396, namely thermal variations. Such thermal variations vary the stiffness of the balance spring, as well as the geometries of the balance spring and of the balance, which changes the spring constant and inertia, and therefore the oscillation frequency. Watchmakers have worked hard to have temperature-stable oscillators and several avenues have been explored/used, including one which won a Nobel Price for Charles-Edouard Guillaume for the development of the Elinvar alloy whose modulus of elasticity increases with temperature and compensates for the increased inertia of the balance. Subsequently, the development of oxidized and therefore temperature-compensated silicon, has surpassed the performance of Elinvar and has the advantage of being less sensitive to magnetic fields. Likewise, the monocrystalline quartz balance spring provides thermal compensation for the change of inertia of the balance. However, unlike oxidized silicon where the thickness of the oxide can be varied according to the material used for the balance, quartz is limited to materials having a coefficient of thermal expansion on the order of 10 ppm/° C., which corresponds, for example, to titanium and to platinum. The main problem with these materials is machinability and control of fine structure and/or perfect finish (mirror polish for example). In the case of titanium, its relatively low density limits its use for large balances, and, in the case of platinum, its high price restricts its use to prestige and luxury products.

SUMMARY OF THE INVENTION

It is an object of the present invention to overcome these drawbacks by proposing a balance made of new materials allowing said balance to be paired with a balance preferably made of monocrystalline quartz, but also of silicon.

Another object of the present invention is to propose a balance made of new materials allowing simpler and more precise manufacturing, so as to reduce, for example, the dispersion of inertia and/or of unbalance within the same production batch.

To this end, the invention relates firstly to a balance for timepieces comprising a rim, a hub and at least one arm connecting the hub to said rim, at least one portion of the balance being made of an at least partially amorphous metal alloy.

According to the invention, said at least partially amorphous metal alloy is based on an element chosen from the group consisting of platinum, zirconium and titanium, and has a coefficient of thermal expansion comprised between 7 ppm/° C. and 12 ppm/° C.

The present invention also concerns a method for manufacturing a balance wherein the rim, the hub and the arms are made of said at least partially amorphous metal alloy based on an element chosen from the group consisting of platinum, zirconium and titanium as defined above, comprising the following steps:

a) making a mould having the negative form of the balance;
b) introducing into the mould said at least partially amorphous metal alloy based on an element chosen from the group consisting of platinum, zirconium and titanium, said metal alloy being heated to a temperature comprised between its glass transition temperature and its crystallization temperature in order to be hot-formed;
c) cooling said metal alloy at a cooling rate selected to obtain a balance made of said at least partially amorphous metal alloy based on an element chosen from the group consisting of platinum, zirconium and titanium,
d) releasing the balance obtained in step c) from its mould.

The present invention also concerns a resonator comprising a balance as defined above and a monocrystalline quartz balance spring.

Such an at least partially amorphous metal alloy based on platinum, zirconium or titanium makes it possible to produce a balance able to be paired with a monocrystalline quartz balance spring.

By means of the properties of amorphous metals, a balance made of at least partially amorphous metal alloy based on platinum, zirconium or titanium can be made using a simplified manufacturing method, such as a casting process or a hot forming process. Further, the at least partially amorphous metal alloy based on platinum, zirconium or titanium has the property of having a much higher elastic range than its crystalline equivalent, owing to the absence of dislocation. This property makes it possible to overmould or to integrate in the balance elements that can not only improve centring but also adjust the inertia and/or unbalance.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
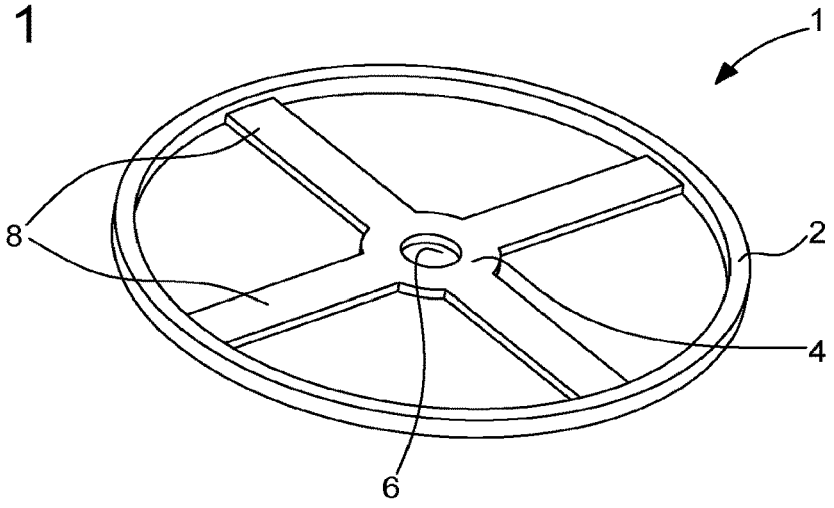
FIG. 1 is a perspective view of a balance according to the invention.

Referring to FIG. 1, there is represented a balance 1 for timepieces. Such a balance 1 comprises, in a conventional manner, a continuous or non-continuous rim 2, defining the external diameter of balance 1, a hub 4, forming the central portion thereof and provided with a hole 6 intended to receive an arbor (not represented) defining the axis of pivoting of balance 1. Hub 4 is securely connected to rim 2 by arms 8. Arms 8 are four in number here and are disposed at 90°. There are also usually balances with two or three arms, disposed respectively at 180° or 120°.

At least one portion of balance 1 is made of a partially or completely amorphous metal alloy. 'At least partially amorphous' material means that the material is capable of plastic deformation when it is heated to a temperature comprised between its glass transition temperature and its crystallization temperature and capable of solidifying in at least partially amorphous phase.

According to the invention, said at least partially amorphous metal alloy is based on an element chosen from the group consisting of platinum, zirconium and titanium, and has a coefficient of thermal expansion comprised between 7 ppm/° C. and 12 ppm/° C.

In the present description, the expression 'based on an element' means that said metal alloy contains at least 50% by weight of said element.

Said at least partially amorphous metal alloy used in the present invention can be platinum-based and has a coefficient of thermal expansion comprised between 8 ppm/° C. and 12 ppm/° C.

Such an at least partially amorphous metal alloy based on platinum can be made up, in atomic percentage values, of

- a platinum base, the content of which makes up the remainder,
- 13 to 17% of copper
- 3 to 7% of nickel
- 20 to 25% of phosphorus.

The at least partially amorphous metal alloy used in the present invention can also be zirconium-based and has a coefficient of thermal expansion comprised between 8 ppm/° C. and 11 ppm/° C.

Such an at least partially amorphous metal alloy based on zirconium can be made up, in atomic percentage values, of

- a zirconium base, the content of which makes up the remainder,
- 14 to 20% of copper
- 12 to 13% of nickel
- 9 to 11% of aluminium
- 2 to 4% of niobium.

The at least partially amorphous metal alloy used in the present invention can also be titanium-based and has a coefficient of thermal expansion comprised between 8 ppm/° C. and 11 ppm/° C.

Such an at least partially amorphous metal alloy based on titanium can be made up, in atomic percentage values, of

- a titanium base, the content of which makes up the remainder,
- 5 to 45% of Cu
- 2 to 25% of Ni
- 2 to 30% of Zr
- 2 to 15% of Sn
- 0 to 5% of Si
- 0 to 5% of Hf.

Ideally, the alloys used in the invention do not contain any impurities. However, they may contain traces of impurities which can result, often inevitably, from the production of said alloys.

The platinum, titanium and zirconium based alloys used in the present invention have the advantage of having a coefficient of thermal expansion lower than 12 ppm/° C. and higher than 7 ppm/° C. They can therefore be used to make at least one portion of a balance which will be paired with a monocrystalline quartz balance spring.

More preferably, said at least partially amorphous metal alloy based on platinum used in the present invention is made up, in atomic percentage values, of:

57.5% Pt, 14.7% Cu, 5.3% Ni, 22.5% P

Such an alloy has a coefficient of thermal expansion comprised between 11 and 12 ppm/° C.

More preferably, said at least partially amorphous metal alloy based on zirconium used in the present invention is made up, in atomic percentage values, of:

58.5% Zr, 15.6% Cu, 12.8% Ni, 10.3% Al, 2.8% Nb

Such an alloy has a coefficient of thermal expansion comprised between 10.5 and 11 ppm/° C.

More preferably, said at least partially amorphous metal alloy based on titanium used in the present invention is made up, in atomic percentage values, of:

42.5% Ti, 7.5% Zr, 40% Cu, 5% Ni, 5% Sn

Such an alloy has a coefficient of thermal expansion comprised between 8 and 11 ppm/° C.

According to a first embodiment of the invention, rim 2, hub 4 and arms 8 are made of the same at least partially amorphous metal alloy based on platinum, zirconium or titanium as defined above. Advantageously, balance 1 is one-piece, i.e. made in a single part.

Balance 1 can, for example, be made entirely of the platinum-based alloy defined above. Since platinum has a high density (21000 kg/m$^3$), the at least partially amorphous platinum-based alloy used in the invention also has a high density (15.5 g/cm$^3$), so that the addition of elements made of dense material to increase the inertia of the balance will not necessarily be required.

Balance 1 can also be entirely made from the at least partially amorphous zirconium or titanium-based alloy defined above. Since zirconium or titanium have a lower density, the at least partially amorphous zirconium or titanium-based alloy used in the invention also has a lower density (6.5 g/cm$^3$ for zirconium and 5.5 g/cm$^3$ for titanium), so that the addition of elements made of denser material to increase the inertia of the balance is recommended, particularly if one wishes to make a small balance for small movements. These elements make it possible to increase the inertia of the balance while maintaining an attractive rim geometry with good aerodynamic properties.

Figure 2:
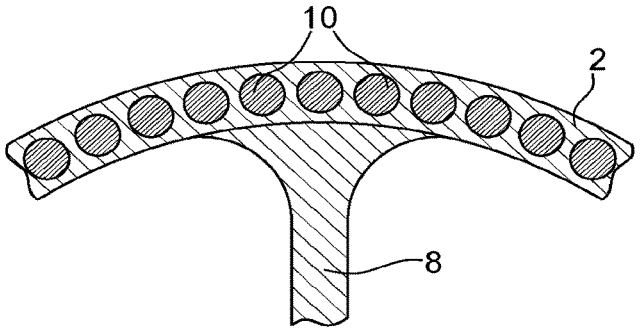
FIG. 2 is a partial top view of a variant of a balance according to the invention.

Thus, according to a first variant represented in FIG. 2, rim 2 can comprise first overmoulded inertia adjustment elements 10, said first inertia adjustment elements 10 being made of a material having a higher density than the density of said at least partially amorphous metal alloy. These first inertia adjustment elements 10 can, for example, be made of tungsten or tungsten carbide, and are obtained by overmoulding.

Figure 3:
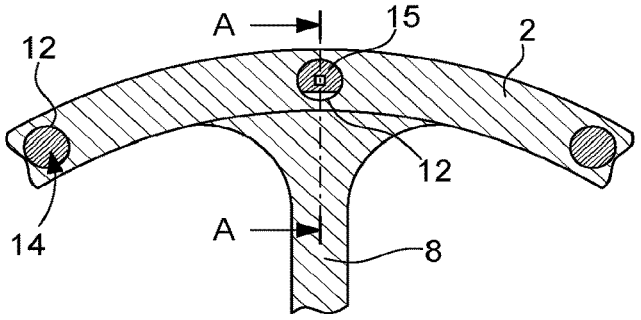
FIG. 3 is a partial top view of another variant of a balance according to the invention.
Figure 4:
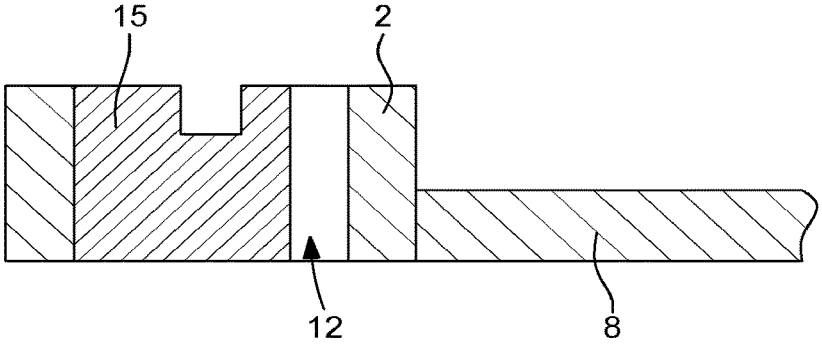
FIG. 4 is a sectional view along axis A-A of FIG. 3.

According to a second variant represented in FIG. 3, rim 2 can comprise housings 12 intended to receive second inertia and/or unbalance adjustment elements 14, 15. These housings 12 can advantageously be provided during the manufacture of balance 1 by moulding, as will be seen below. Second inertia and/or unbalance adjustment elements 14, 15 can be, for example, inertia blocks, split inertia blocks, pins 14, split pins, or pins with an unbalance 15, which act as inertia blocks. These elements are press fitted or clipped into the corresponding housings 12. FIG. 3 represents a pin 14 inserted into its housing 12, and a pin with an unbalance 15 inserted into its housing 12. FIG. 4 shows a sectional view along line A-A of FIG. 3 representing pin with an unbalance 15 inserted into housing 12 arranged in rim 2.

It is obvious that these elements for increasing the inertia of the balance are preferably used with an at least partially amorphous zirconium or titanium-based rim but can also be used with a rim made of another material in a balance according to the invention.

To increase the inertia of the balance, it is also possible to provide a thicker or wider rim, particularly in the case of larger balances.

The housings 12 represented in FIG. 3 can also form housings intended to receive decorative and/or luminescent elements, such as tritium tubes (not represented).

According to another variant of the invention, hub 4 can comprise integrated, flexible, centring elements, which allow the balance to self-centre during its assembly on an arbor through the elastic deformation of said flexible centring elements.

Figure 5:
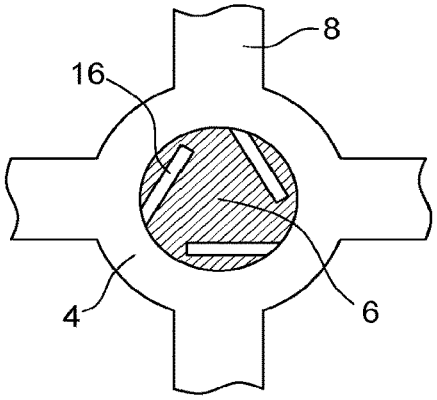
FIGS. 5 to 10 are partial top views of other variants of a balance according to the invention.
Figure 6:
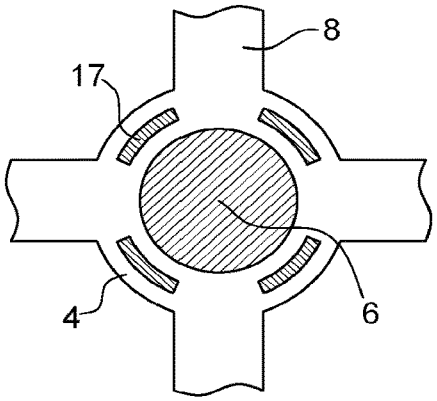

According to FIG. 5, said integrated, flexible, centring elements 16 are elastic strips arranged on the inner edge of hub 4 in order to be positioned inside hole 6. In FIG. 6, said integrated, flexible, centring elements 17 are arranged on the surface of hub 4 and are distributed around hole 6. Flexible centring elements 16 and 17 can advantageously be set in place during the manufacture of balance 1 by moulding, as will be seen below.

According to another variant of the invention, at least one of arms 8 carries third integrated, flexible, inertia adjustment elements.

Figure 7:
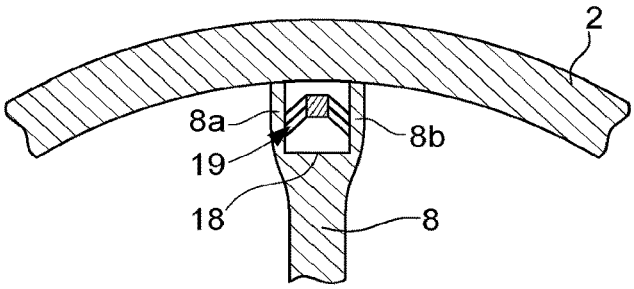

In FIG. 7, the end of arm 8 on the side of rim 2 ends in two branches 8*a*, 8*b* forming therebetween a housing 18 in which is integrated a third, flexible, bistable, V-shaped, inertia adjustment element 19 for adjustment of the frequency.

Figure 8:
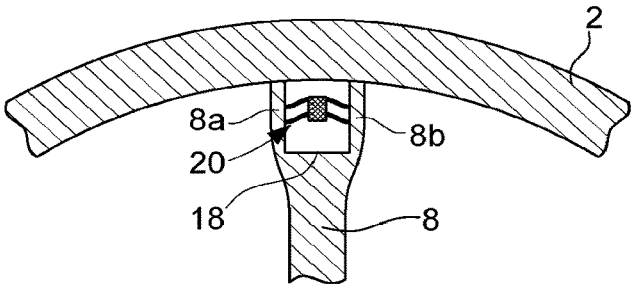

In FIG. 8, a third, flexural buckling inertia adjustment element 20 for adjustment of the frequency. To this end, the third inertia adjustment element 20 is made of a material having different expansion properties from the at least partially amorphous metal alloy based on platinum, zirconium or titanium of the balance of the invention, such as silicon or silicon oxide.

Figure 9:
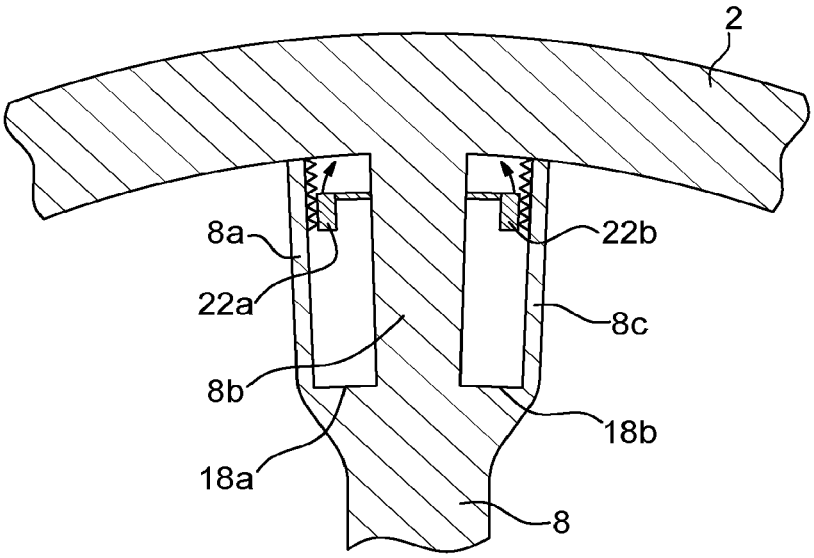

In FIG. 9, the end of arm 8 on the side of rim 2 ends in three branches 8*a*, 8*b*, 8*c* forming therebetween two housings 18*a*, 18*b* in which are integrated third, flexible, multistable, inertia adjustment click elements 22*a*, 22*b* for adjustment of the frequency.

These three, flexible, inertia adjustment elements 19, 20, 22*a*, 22*b* for adjusting the frequency can advantageously be set in place during the manufacture of balance 1 by moulding, as will be seen below.

These three, flexible, inertia adjustment elements 19, 20, 22*a*, 22*b* for adjusting the frequency can be used both when the entire balance is made of at least partially amorphous metal alloy based on zirconium, titanium or platinum according to the invention, and when the arms are made of at least partially amorphous metal alloy based on zirconium, titanium or platinum, with the rest of the balance, and particularly the rim, being made of another material.

Figure 10:
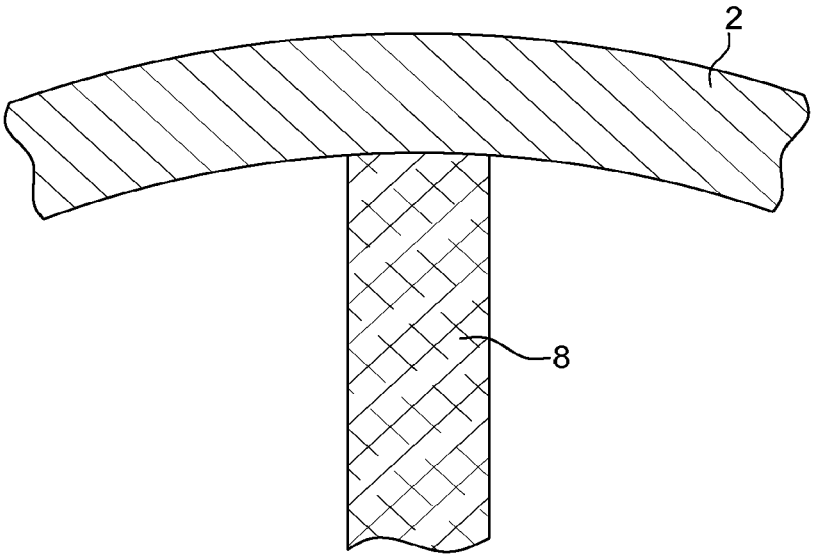

According to another variant of the invention, one of either arm 8, rim 2 or hub 4 has a structured surface condition. Only one of the elements may have a structured surface condition, or all of the elements of the balance may have a structured surface condition; this structured surface condition may be identical or different. FIG. 10 represents a balance of the invention wherein rim 2 has a different structured surface condition from the structured surface condition presented by arm 8. This structured surface condition can be a polished, satin-finish, sanded, circular-grained, sunray condition, etc. It is possible to also arrange microstructures inside the mould for manufacturing the balance which form a photonic network in order to replicate these microstructures on the surface of the balance. These microstructures can create a photonic crystal giving the part a certain colour, a hologram, or a diffraction array capable of forming an anti-counterfeiting element. The structures are introduced directly into the mould and are replicated during the manufacture of the balances by hot forming, which obviates the need for finishing operations.

According to a second embodiment of the invention, the balance arms and hub are made of the same at least partially amorphous metal alloy based on zirconium, titanium or platinum as defined above, the rim being made of a material having a higher density than the density of said at least partially amorphous metal alloy used for the arms and the hub. This material can itself be the at least partially amorphous platinum-based metal alloy defined above or another material. For example, the balance arms and hub are made of the at least partially amorphous zirconium or titanium-based metal alloy defined above to allow the balance to be paired with a monocrystalline quartz balance spring, and the rim is made of another material having a higher density than the density of the at least partially amorphous zirconium or titanium-based metal alloy used for the arms and the hub in order to improve the inertia of the balance.

It is evident that, in this second embodiment of the invention, the rim can comprise the same first inertia adjustment elements or the same housings for receiving the second inertia and/or unbalance adjustment elements or decorative and/or luminescent elements as those described above for the first embodiment of the invention. Likewise, the hub can comprise the same integrated, flexible, centring elements as those described above for the first embodiment of the invention. Likewise, the arms can comprise the same third, integrated, flexible, inertia adjustment elements as those described above for the first embodiment of the invention. Likewise, the balance elements can have structured surface conditions as described above for the first embodiment of the invention.

The present invention also concerns a method for manufacturing a balance 1 wherein the rim 2, hub 4 and arms 8 are made of said partially or completely amorphous platinum, zirconium or titanium-based metal alloy, as defined above, comprising the following steps:

a) making a mould having the negative form of the balance, possibly providing the microstructures forming a decoration or a photonic network on the surface
b) introducing into the mould said at least partially amorphous metal alloy based on an element chosen from the group consisting of platinum, zirconium and titanium, the metal alloy being heated to a temperature comprised between its glass transition temperature and its crystallisation temperature in order to be hot formed in the balance mould c) cooling said metal alloy at a cooling rate selected to obtain a balance in said partially or completely amorphous metal alloy based on an element chosen from the group consisting of platinum, zirconium and titanium d) releasing the balance obtained in step c) from its mould.

To make a balance in partially or completely amorphous metal alloy based on platinum, zirconium or titanium, it is advantageous to use the properties of the metal in an at least partially amorphous state in order to shape it.

Indeed, the at least partially amorphous metal is very easy to shape, allowing higher precision in the manufacture of parts with complicated shapes. This is due to the particular characteristics of amorphous metal, which can soften while remaining at least partially amorphous for a certain period of time within a given temperature range [Tg-Tx] peculiar to each alloy (for example for the Zr-based alloy: Tg=440° C. and Tx=520° C.). It is therefore possible to shape it under relatively low stress and at a low temperature, thus allowing the use of a simplified process such as hot forming. The use of such a material also allows fine geometries to be reproduced with high precision, since the viscosity of the alloy decreases sharply with temperature within the temperature range [Tg-Tx] and the alloy thus moulds to all the details of the negative die. For example, for a platinum-based material as defined above, shaping occurs at around 300° C. for a viscosity of up to $10^3$ Pa·s with a force of 1 MPa, instead of a viscosity of $10^{12}$ Pa·s at temperature Tg. The use of dies has the advantage of creating high-precision, three-dimensional components, which cannot be obtained with cutting or stamping processes.

One method used is the hot forming of an amorphous preform. This preform is obtained by melting metal elements intended to form the partially or completely amorphous metal alloy based on platinum, zirconium or titanium in a furnace. Melting is carried out in a controlled atmosphere with the aim of obtaining the lowest possible oxygen contamination of the alloy. Once these elements have melted, they are cast in the form of a semi-finished product, then rapidly cooled to preserve the partially or completely amorphous state. Once the preform is made, hot forming is carried out to obtain a finished part. Hot forming is achieved by a pressing process in a temperature range comprised between the glass transition temperature Tg and the crystallisation temperature Tx of the metal alloy for a determined time to maintain an at least partially amorphous structure. This is done in order to maintain the characteristic elastic properties of amorphous metals.

Typically for the Zr-based alloy and a temperature of 440° C., the pressing time should not exceed around 120 seconds. Thus, hot forming preserves the initial at least partially amorphous state of the preform. The various final shaping steps of the one-piece balance according to the invention are then:

1) heating dies having the negative form of the balance to a selected temperature.

2) inserting the at least partially amorphous metal preform between the hot dies, 3) applying a closing force to the dies to reproduce the geometry of said dies on the at least partially amorphous metal preform, 4) waiting for a chosen maximum time, 5) opening the dies.

6) rapidly cooling the balance below Tg so that the material maintains its at least partially amorphous state, and 7) removing the balance from the dies.

Of course, the balance can be made by casting or injection moulding. This method consists in casting or injecting the metal alloy, heated to a temperature comprised between its glass transition temperature and its crystallisation temperature to be at least partially amorphous, into a mould having the form of the final part. Once the mould has been filled, it is rapidly cooled to a temperature below $T_g$ to prevent crystallization of the alloy and thereby obtain a balance made of at least partially amorphous metal alloy as defined above.

The mould can be reused or dissolved to release the parts. The moulding method has the advantage of perfectly replicating the geometry of the balance, including any decorations or surface structuring. This results in reduced dispersion of inertia and better centring over a production batch of balances. The moulding method makes it possible to obtain a balance with attractive geometry, with acute interior angles, a convex rim and/or arm profile, and a perfect finish. It is also possible to provide a non-continuous rim. For maximum quality, the mould will be made of silicon using a DRIE process. It is evident that the mould can also be produced by milling, laser, EDM or any other type of machining process.

The characteristic elastic properties of at least partially amorphous metals are used to overmould or integrate functional and/or decorative elements in the rim and/or in the arms and/or in the hub, for example by means of corresponding inserts placed inside the mould prior to the introduction of the metal alloy which is heated to between its glass transition temperature and its crystallisation temperature to be at least partially amorphous.

More particularly, the method of the invention can comprise a step of overmoulding first inertia adjustment elements 10 in rim 2, by means of inserts, which are placed inside the mould prior to the introduction of the metal alloy heated to between its glass transition temperature and its crystallisation temperature to be at least partially amorphous, and overmoulded.

The method of the invention can also comprise a step of overmoulding flexible centring elements 16, 17 on hub 4, on its inner edge or on its surface.

The method of the invention can also comprise a step of overmoulding third, flexible, inertia adjustment elements 19, 20, **22*a*, 22*b* in arm 8**.

The moulding method also makes it possible to provide a mould which has microstructures forming a decoration or a photonic network in order to obtain structured surface conditions on the arms and/or the hub and/or the rim, as described above. It is also possible to add a logo to the mould.

The present invention also concerns a method for manufacturing a balance wherein the hub and at least one arm are made of the at least partially amorphous metal alloy based on zirconium, titanium or platinum defined above, the rim being made of a material having a higher density than the density of said at least partially amorphous metal alloy used for the arms and the hub, said method comprising the following steps:

a) making a mould having the negative form of the balance;

a') inserting into the mould a rim or rim elements made of a material having a higher density than the density of the at least partially amorphous metal alloy based on platinum, zirconium or titanium used for the arms and the hub b) introducing into the mould said at least partially amorphous metal alloy based on an element chosen from the group consisting of platinum, zirconium and titanium, this metal alloy being heated to a temperature comprised between its glass transition temperature and its crystallisation temperature in order to be hot formed in the balance mould c) cooling said metal alloy at a cooling rate selected to obtain a balance made of at least partially amorphous metal alloy based on an element chosen from the group consisting of platinum, zirconium and titanium, d) releasing the balance obtained in step c) from its mould.

The present invention also concerns a resonator comprising a balance as defined above and a monocrystalline quartz balance spring.

Thus, the balance according to the invention is made of a material that allows a simple manufacturing method to be used, while having a coefficient of thermal expansion that allows it to be paired with a monocrystalline quartz balance spring. The balance according to the invention also makes it possible to have at least arms that have a coefficient of thermal expansion allowing it to be paired with a monocrystalline quartz balance spring, while having a high inertia, maintaining a compact and attractive rim geometry, of small volume, using a suitable rim, either comprising elements made of a higher density material, or itself being made of a higher density material.

It is also possible to perform a heat treatment to adjust the expansion coefficient of the partially amorphous material in its final form by relaxing the amorphous structure (without crystallisation).

It is also possible to adjust the expansion coefficient by partial, controlled crystallisation of the partially amorphous material in its final form.

The invention claimed is:

1. A balance for a timepiece, comprising:

a rim;

a hub; and at least one arm that extends continuously in a radial direction between the hub and said rim, a first end of the arm being directly connected to the hub and a second end of the arm being directly connected to the rim, the second end of the arm including a first branch and a second branch each directly connected to the rim, the first branch and the second branch being separate from one another to form a first housing between the first branch and the second branch, and a flexible inertia adjustment element is positioned in the first housing, the flexible inertial adjustment element extending from the first branch to the second branch, wherein at least one portion of the balance is made of a partially or completely amorphous metal alloy, wherein said at least partially amorphous metal alloy is based on an element chosen from the group consisting of platinum, zirconium and titanium, and has a coefficient of thermal expansion comprised between 7 ppm/° C. and 12 ppm/° C.

2. The balance according to claim 1, wherein the hub and the arm are made of said at least partially amorphous metal alloy, the rim being made of a first material having a higher density than the density of said at least partially amorphous metal alloy of which the hub and the arms are made.

3. The balance according to claim 1, wherein the rim, the hub, and the arm are made of said at least partially amorphous metal alloy.

4. The balance according to claim 3, wherein the rim comprises overmoulded first inertia adjustment elements, said first inertia adjustment elements being made of a second material having a higher density than the density of said at least partially amorphous metal alloy.

5. The balance according to claim 1, wherein the rim comprises housings configured to receive second inertia and/or unbalance adjustment elements.

6. The balance according to claim 1, wherein the rim comprises housings configured to receive decorative and/or luminescent elements.

7. The balance according to claim 1, wherein the hub comprises integrated, flexible, centring elements.

8. The balance according to claim 7, wherein said integrated, flexible, centring elements are arranged on the inner edge of the hub.

9. The balance according to claim 1, wherein either the arm, the rim, or the hub has a structured surface condition.

10. The balance according to claim 1, wherein said at least partially amorphous metal alloy is platinum-based and has a coefficient of thermal expansion comprised between 8 ppm/° C. and 12 ppm/° C.

11. The balance according to claim 1, wherein the flexible inertia adjustment element is V-shaped and bistable.

12. The balance according to claim 1, wherein the flexible inertia adjustment element is made of a material having different expansion properties from the at least partially amorphous metal alloy.

13. The balance according to claim 1, wherein the flexible inertia adjustment element is silicon or silicon oxide.

14. The balance according to claim 1, wherein the second end of the arm includes a third branch, a second housing is formed between the second branch and the third branch, and another flexible inertia adjustment element is positioned in the second housing and extends between the second branch and the third branch.

15. A resonator comprising:

a balance comprising a rim, a hub, and at least one arm that extends continuously in a radial direction between the hub and said rim, a first end of the arm being directly connected to the hub and a second end of the arm being directly connected to the rim, the second end of the arm including a first branch and a second branch each directly connected to the rim, the first branch and the second branch being separate from one another to form a housing between the first branch and the second branch, and a flexible inertia adjustment element is positioned in the housing, the flexible inertial adjustment element extending from the first branch to the second branch, at least one portion of the balance being made of a partially or completely amorphous metal alloy, wherein said at least partially amorphous metal alloy is based on an element chosen from the group consisting of platinum, zirconium and titanium, and has a coefficient of thermal expansion comprised between 7 ppm/° C. and 12 ppm/° C. and a monocrystalline quartz balance spring.

* * * * *